US007481469B2

(12) United States Patent
Harrer

(10) Patent No.: US 7,481,469 B2
(45) Date of Patent: Jan. 27, 2009

(54) DOOR LOCK FOR AN OVEN

(75) Inventor: Hubert Harrer, Hilpotstein (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 49 days.

(21) Appl. No.: 11/809,576

(22) Filed: Jun. 1, 2007

(65) Prior Publication Data

US 2007/0241568 A1 Oct. 18, 2007

Related U.S. Application Data

(63) Continuation of application No. PCT/EP2005/011053, filed on Oct. 14, 2005.

(30) Foreign Application Priority Data

Dec. 20, 2004 (DE) ..... 10 2004 061 231

(51) Int. Cl.
*E05C 3/06* (2006.01)

(52) U.S. Cl. ..... 292/201; 292/DIG. 69; 292/95; 292/99

(58) Field of Classification Search ..... 292/201, 292/216, DIG. 69, 109, 111, 95, 99; 126/197, 126/19 R; 219/398
See application file for complete search history.

(56) References Cited

U.S. PATENT DOCUMENTS 2,789,852 A 4/1957 Eads
3,540,767 A * 11/1970 Siegel ..... 292/210
3,823,294 A * 7/1974 Takayama et al. ..... 219/724
4,088,354 A 5/1978 Kolendowicz
4,838,586 A * 6/1989 Henne ..... 292/113
4,927,996 A 5/1990 Genbauffe et al.
6,601,882 B1 8/2003 Cole
6,698,418 B2 * 3/2004 Ramsey et al. ..... 126/197
6,966,582 B1 * 11/2005 Malone et al. ..... 292/95
2005/0194792 A1 * 9/2005 Lomicka et al. ..... 292/96

FOREIGN PATENT DOCUMENTS

EP 1 388 601 A1 2/2004

* cited by examiner

*Primary Examiner*—Patricia Engle
*Assistant Examiner*—Mark Williams
(74) *Attorney, Agent, or Firm*—Laurence A. Greenberg; Werner H. Stemer; Ralph E. Locher

(57) ABSTRACT

A door lock for an oven includes a lock housing, a geared motor, an actuating shaft to be driven by the geared motor, a retaining plate and a locking element formed as a lever to be operated by the actuating shaft. The lever is mounted on the retaining plate and has a lever axle for reversibly changing location relative to the lock housing. A spring exerts a force being overcome in an emergency-unlocking function permitting adjustment of the retaining plate to allow opening of the lever having been previously brought into a locking position by the actuating shaft, without further operation of the actuating shaft. The actuating shaft is adjustable along its axis by the lever having been unlocked in an emergency.

11 Claims, 9 Drawing Sheets

DOOR LOCK FOR AN OVEN

CROSS-REFERENCE TO RELATED APPLICATION

This is a continuing application, under 35 U.S.C. § 120, of copending International Application No. PCT/EP2005/011053, filed Oct. 14, 2005, which designated the United States; this application also claims the priority, under 35 U.S.C. § 119, of German Patent Application 10 2004 061 231.5-16, filed Dec. 20, 2004; the prior applications are herewith incorporated by reference in their entirety.

BACKGROUND OF THE INVENTION

Field of the Invention

The invention relates to a locking apparatus for the door of a baking oven, in particular a baking oven with a pyrolytic self-cleaning function. A door lock of that type is known, for example, from German Patent DE 197 05 821 C1 and from U.S. Pat. No. 4,927,996.

Temperatures in the region of 500° C. and above are produced during the pyrolytic self-cleaning of baking ovens. That temperature load can easily cause warping of components of the oven. That may result in the door of the oven not being reliably locked during pyrolytic cleaning of the oven. Irrespective of safety aspects, an only limited operability of a locking apparatus of an oven can also lead to unnecessary heat losses. The operability of a locking apparatus can also be impaired by production-related tolerances.

BRIEF SUMMARY OF THE INVENTION

It is accordingly an object of the invention to provide a locking apparatus for a door of a baking oven, in particular a pyrolysis oven, which overcomes the hereinafore-mentioned disadvantages of the heretofore-known devices of this general type and which is distinguished by a specific robustness and insensitivity to tolerances.

With the foregoing and other objects in view there is provided, in accordance with the invention, a door lock for an oven. The door lock comprises a lock housing, a geared motor, an actuating shaft to be driven by the geared motor and having an axis, a retaining plate, and a locking element formed as a lever to be operated by the actuating shaft. The lever is mounted on the retaining plate and has a lever axle for reversibly changing location relative to the lock housing. A spring exerts a force being overcome in an emergency-unlocking function permitting adjustment of the retaining plate to allow opening of the lever having been previously brought into a locking position by the actuating shaft, without further operation of the actuating shaft. The actuating shaft is adjustable along the axis by the lever having been unlocked in an emergency.

This door lock has an electromotive drive, an actuating shaft which can be driven by the drive, and a locking element which can be operated by the actuating shaft. The locking element which is provided is a lever having a lever axle that can be moved in a reversible manner in relation to the lock housing, in particular can be moved against a spring force. By virtue of the fact that the lever, which locks the door of the baking oven, is mounted not only in such a way that it can be pivoted about its lever axle but also as a whole, including the lever axle, in a movable manner in the housing of the door lock, an effective locking function is always provided. This applies particularly even in cases where components of the oven are warped by the effect of heat. The lever of the locking apparatus therefore has at least two degrees of freedom, namely one degree of freedom relating to the pivoting movement and an additional degree of freedom, in particular relating to a translatory movement.

In accordance with another feature of the invention, which is particularly simple in terms of construction, the lever is mounted in a slot. Instead of mounting the lever through the use of a slot, the lever axle can also be moved linearly or along a specific path in some other way. The slot or the other guide of the lever axle is preferably constructed in such a way that the lever axle is pulled in a defined direction within the slot when a force is applied on the lever by the door of the oven in the opening direction, that is to say when an attempt is made to open the locked door. To this end, the slot is inclined by less than 90°, for example 60° to 85°, in relation to the axis of the actuating shaft. In this case, the axis of the actuating shaft indicates at least approximately the direction in which a force is exerted on the door and therefore on the locking apparatus during the attempt to open the oven. In this embodiment, the actuating shaft and the lever which is operated by the actuating shaft are disposed approximately at right angles to the plane in which the oven door is located.

In accordance with a further feature of the invention, a spring force can be applied to the lever of the locking apparatus in a defined manner in order to assume a specific angular position and a specific axial position. In one preferred refinement, the two functions, that is to say exerting a force which acts in the direction of a specific angular position, namely the open position of the lever, and exerting a force which acts on the lever axle in the direction of a defined end position within the slot, are realized by a single spring. In this case, the spring attempts to always position the lever axle in such a way that the lever can engage to the maximum extent in a mating piece, which is provided for locking purposes, of the door of the oven.

In accordance with an added feature of the invention, a particularly space-saving construction of the locking apparatus can be achieved by the lever extending substantially parallel to the axis of the actuating shaft. Particularly in the closed state of the lever, that is to say the state in which the door of the oven is locked, the lever forms an acute angle of, for example, only less than 10°, in particular less than 5°, with the axis of the actuating shaft. In the opened state of the lever, the lever is, in contrast, inclined in a more pronounced manner in relation to the axis of the actuating shaft, for example through an angle of up to 30°. In this case, the lever axle is disposed transverse to the axis of the actuating shaft.

In accordance with an additional feature of the invention, in one preferred refinement, the actuating shaft has, in addition to contouring, which is provided to operate the lever, for example in the form of one or more actuating cams, at least one further operating contour which actuates an electrical locking contact system.

Furthermore, the door lock preferably includes a door contact system which is mechanically independent of the position of the actuating shaft and of the lever. The door contact system detects the position of the door of the oven. This door contact system operates in a compact manner, preferably with a slide which can be operated by the door of the oven and is disposed parallel to the actuating shaft (and therefore also largely parallel to the lever) in the lock housing.

In accordance with yet another feature of the invention, the lever of the door lock is mounted on a retaining plate which can be moved in the lock housing, in particular in the axial direction of the actuating shaft. In this context, a retaining plate is understood to be any desired part, irrespective of geometric construction, on or in which the axle of the lever, that is to say of the locking element, is mounted. In this case, the lever axle can be fixed or movable, particularly in such a way that it can be moved in a slotted guide, in relation to the retaining plate. In the last-mentioned preferred case, the lever axle therefore has a plurality of translation options which are linearly independent of one another. The lever therefore has a total of three degrees of freedom, namely the ability to pivot about the lever axle, the ability to move the lever axle in the slot, and the ability to move the retaining plate, including the slot.

By virtue of mounting the lever on or in the movable retaining plate, a plurality of functions can be fulfilled, in combination too, namely an emergency-unlocking function and a closing function in particular. The emergency-unlocking function means that it is possible to open the lever, which was previously moved to the locking position through the use of the actuating shaft, as soon as the force of a spring is overcome, without operating the actuating shaft. During the emergency-unlocking process, that is to say the forcible opening of the oven door despite the actuating shaft being in the locking position, the retaining plate is moved so far in the axial direction of the actuating shaft by the tensile force on the lever, that the lever no longer makes contact with the operating contour of the actuating shaft but slides out over a front end of an actuating cam or an actuating disk and therefore opens due to a spring force and/or due to the force produced by pulling the door. However, the lever is preferably not completely pulled away from the actuating shaft during emergency unlocking, but only to such an extent that the opened lever is still in contact with the region of the actuating shaft with a reduced diameter. The actuating shaft has an eccentric or a functionally comparable contour in this region of reduced diameter too. The functionally comparable contour makes it possible to move the lever to the locking position again by rotating the actuating shaft through the use of the electric motor.

In the event of the described interaction between the lever and the actuating shaft during emergency unlocking and during subsequent relocking, preference is given not only to the lever axle being able to move transverse to its extent but also to the actuating shaft being able to move, specifically in its axial direction. In this case, a spring force is applied to the retaining plate, which serves to mount the lever, and the actuating shaft in opposite directions, with the spring force acting on the retaining plate being greater than the spring force acting on the actuating shaft. As a result, the actuating shaft is moved in the direction which is averted from the lever, that is to say in the direction of the electric motor, as soon as the lever has opened due to emergency unlocking. This axial movement of the actuating shaft can be used to trigger an electrical actuating operation which indicates the opening of the lever.

The ability of the retaining plate of the lever to move in the axial direction of the actuating shaft, that is to say substantially in the direction in which a force is to be exerted on the door in order to close it, also permits integration of a closing function in the door lock in a particularly simple manner. In this case, a force, through the use of which the retaining plate can be moved in such a way that the door is closed through the use of the lever which hooks into the door, acts permanently on the retaining plate. In this case, the actuating contour of the actuating shaft which interacts with the lever is constructed in such a way that the closing function only comes into effect when the lever is already completely in the locking position. If the lever is still entirely or partly open, that is to say has not yet fully engaged in the corresponding locking contour of the door, the closing function remains blocked by an actuating contour, for example an eccentric element, of the actuating shaft against which the lever rests. The longitudinal movement of the lever, that is to say movement of the lever in the axial direction of the actuating shaft, is enabled by suitable construction of the actuating contour, and therefore activates the closing function, only after the pivoting movement of the lever is complete and given further rotation of the actuating shaft. During subsequent motorized opening of the lever after the pyrolytic self-cleaning process is complete, the lever is first moved in the axial direction of the actuating shaft and then pivoted into the open position by the actuating shaft in reverse order.

Other features which are considered as characteristic for the invention are set forth in the appended claims.

Although the invention is illustrated and described herein as embodied in a door lock for an oven, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF A PREFERRED EMBODIMENT OF THE INVENTION

Figure 1:
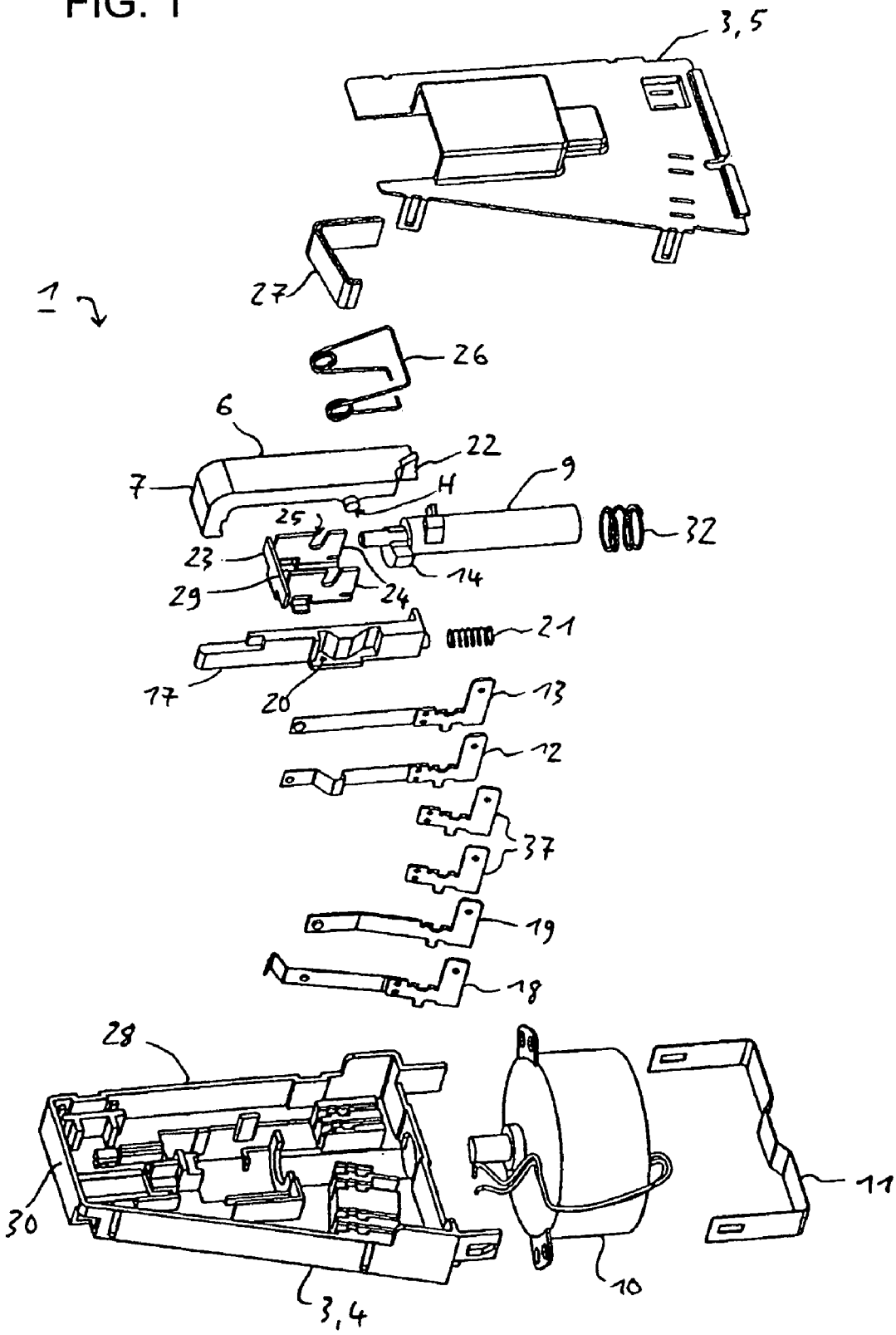
FIG. 1 is a diagrammatic, exploded, perspective view of a door lock for an oven.
Figure 2:
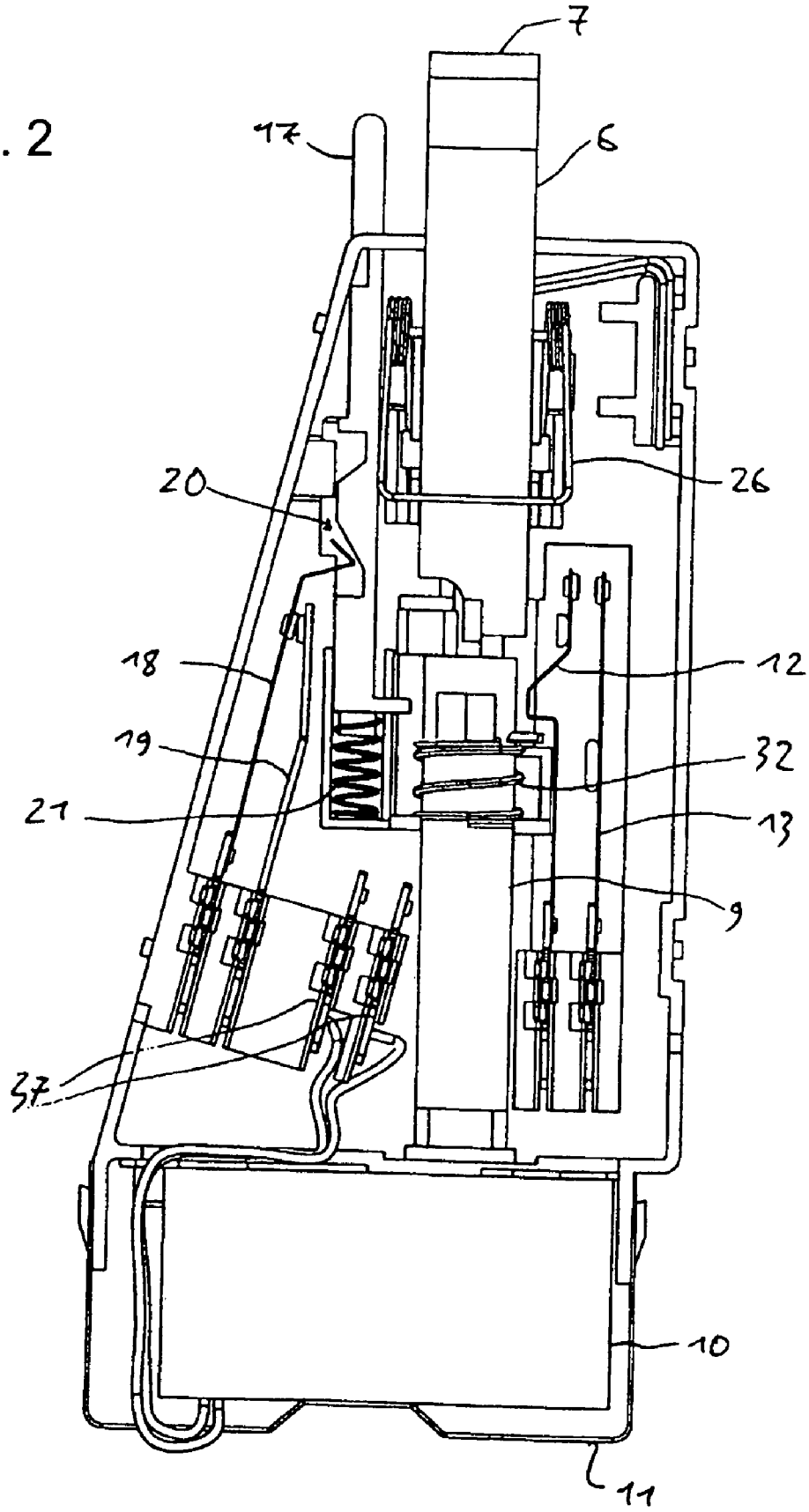
FIG. 2 is a plan view of the door lock according to FIG. 1 in an open, unlocked state.

Referring now in detail to the figures of the drawings, in which corresponding parts or parts which act in an identical manner are provided with the same reference symbols, and first, particularly, to FIGS. 1 to 5 thereof, there is seen a first exemplary embodiment of a door lock 1 for a pyrolysis oven, of which only an oven door 2 (FIG. 4) is shown as a detail. The door lock 1 is installed in the oven in a horizontal position and has a lock housing 3 including a lower housing part 4 and a housing cover 5. A lever protrudes from the housing 3 as a locking element 6. The lever is substantially likewise in a horizontal installation position and can engage in a locking contour 8 of the oven door 2 through the use of a hook 7.

In order to operate the lever 6, that is to say to lock the oven door 2, an actuating shaft 9 is provided which can be driven by a geared motor 10 at a rotational speed of approximately 10 rpm. The geared motor 10 is fastened to the lock housing 3 through the use of a retaining spring 11 and has a shaft which is disposed in a horizontal manner. The actuating shaft 9 is disposed in an extension of the motor shaft. The actuating shaft 9, which is also referred to as an eccentric shaft and is illustrated in detail in FIG. 6, serves firstly to operate the lever 6 and secondly to operate locking contacts 12, 13 which form an electrical locking contact system. In order to operate the lever 6, the actuating shaft 9 has an eccentric worm 14 which merges with a cam 15. The locking contact system 12, 13 is operated by a lug 16 on the actuating shaft 9.

If the lever 6 is closed by rotating the eccentric worm 14 and the oven door 2 is thus locked, the locking contact system 12, 13 is simultaneously closed by the lug 16 and an electrical signal which indicates that the oven door 2 is locked is therefore generated. The pyrolytic self-cleaning operation in the oven is started only when this electrical signal is produced. A precondition for the described motorized locking of the oven door 2 is that the oven door is completely closed. In order to detect whether or not this is the case, a slide 17 is provided which is disposed substantially parallel to the lever 6 and is pushed into the lock housing 3 when the oven door 2 is closed. In the process, door contacts 18, 19 are opened by an actuating contour 20 of the slide 17. A force which pushes the slide 17 out of the lock housing 3, that is to say in the direction of the oven door 2, is exerted by a spring 21. In contrast to the illustrated exemplary embodiment, the door contact system which is formed by the door contacts 18, 19 could also be formed in such a way that the door contacts 18, 19 are closed when the oven door 2 is closed. Similarly, closing and opening functions could also be exchanged in the locking contacts 12, 13. Motor connections 37 are located within the lock housing 3 in order to electrically connect the electric motor 10 to the gear mechanism.

Figure 3:
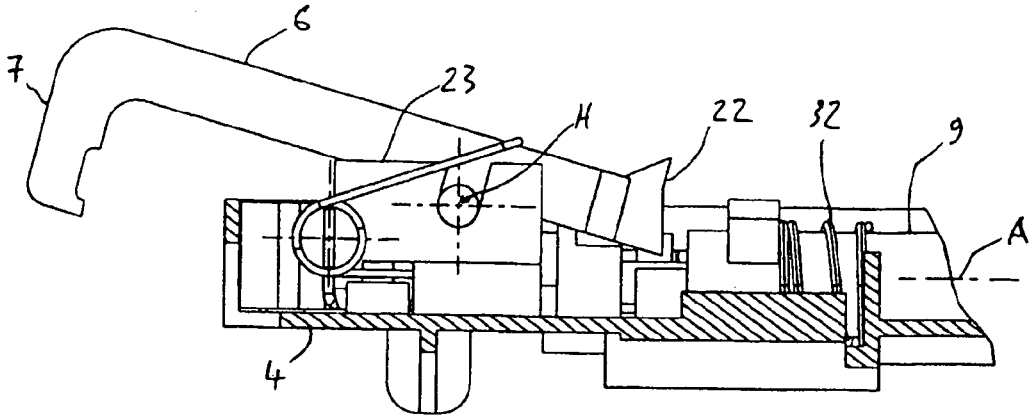
FIG. 3 is a fragmentary, side-sectional view of the apparatus according to FIG. 2, in the open state.
Figure 4:
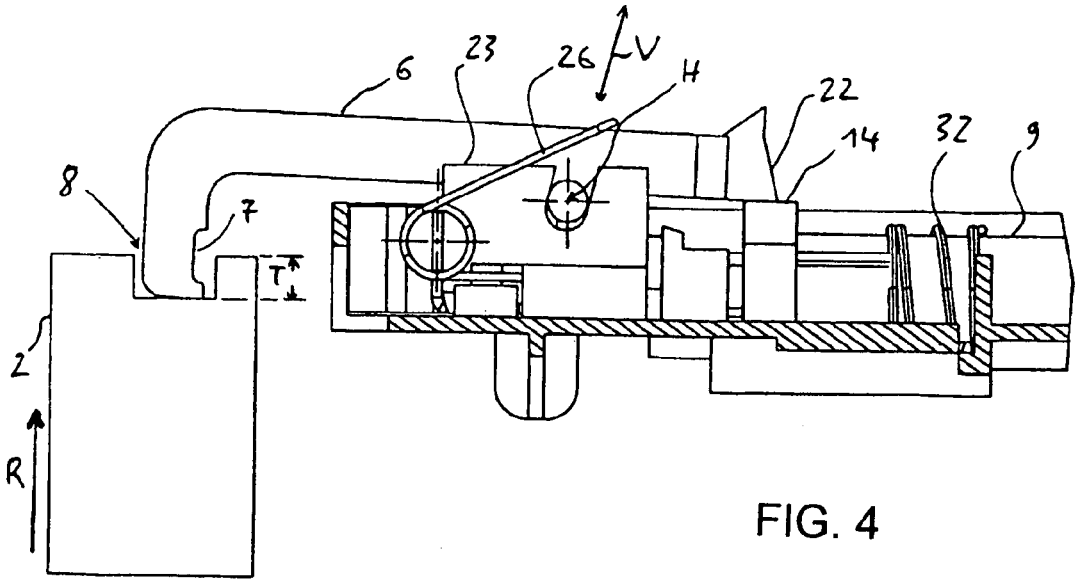
FIG. 4 is a view similar to FIG. 3, of the door lock and an oven door in a closed, locked state.
Figure 5:
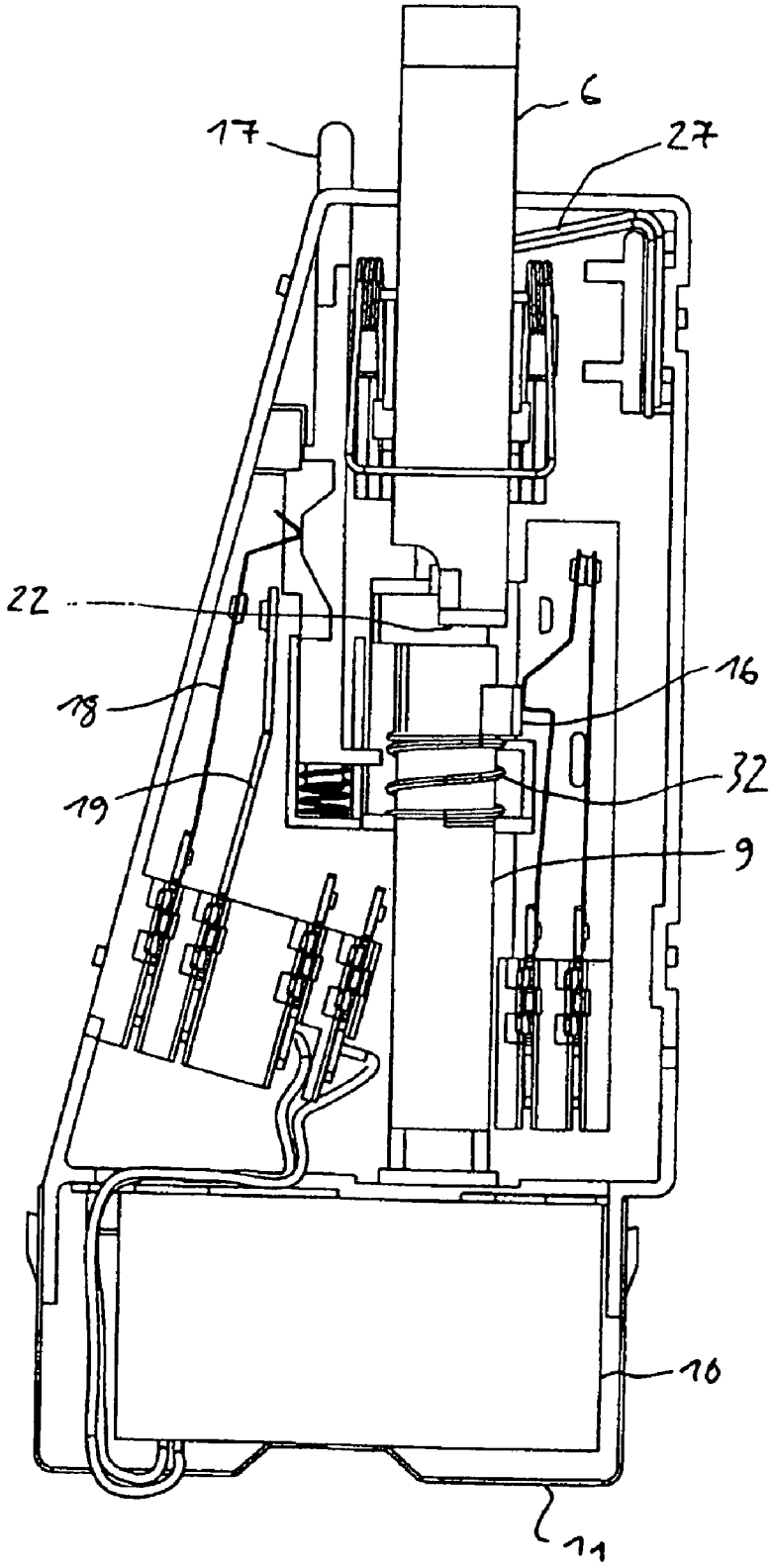
FIG. 5 is a view similar to FIG. 2, of the door lock in the closed, locked state.

As is shown particularly in FIGS. 3 and 4, the locking element 6 forms only an acute angle, specifically an angle of less than 5°, with an axis A of the actuating shaft 9 in the locked state. The locking element 6 is therefore disposed substantially at right angles to the oven door 2. A retaining plate 23 is provided in order to mount the locking element 6, which is in the form of a two-armed lever that has the hook 7 at one of its ends and an operating contour 22 which interacts with the actuating shaft 9 at its other end. The retaining plate 23 is produced as a bent sheet metal part and has two lateral limbs 24, in each of which a slotted guide 25 is formed. The lever 6 is partly disposed between the limbs 24, with a lever axle H being located in the slotted guides 25. In the exemplary embodiment, the slotted guides 25 are open at one end, specifically at the top. However, slotted guides which are closed at both ends could also be used to mount the lever 6.

A spring 26 in the form of a double leg spring is provided in order to push the lever axle H into the slotted guides 25 in the direction of an end position, specifically the end position which faces the lower housing part 4. This spring 26 simultaneously serves to push the lever 6 in the direction of its open position (FIG. 3). The spring 26, together with the slotted guides 25, furthermore permits compensation of tolerances through which, in particular, different positioning of the oven door 2 relative to the door lock 1, for example triggered by thermal stresses or mounting inaccuracies, can be prevented.

When the oven door 2 is locked, the hook 7 of the locking element 6 should, as is illustrated in FIG. 4, utilize an entire depth T of the locking contour 8 as far as possible.

If the oven door 2 were to be shifted upward in a vertical direction R perpendicular to the axis A of the actuating shaft 9, the actuating shaft 9 could no longer be moved completely into the locking position, that is to say into the position in which the cam 15 tilts the lever 6 about the lever axle H as far as possible, if the lever axle H of the locking element 6 were stationary. The result of this is that the locking contact system 12, 13 cannot close and therefore no signal is emitted which indicates that the oven door 2 is locked and the pyrolytic cleaning operation can be started. In the case of a stationary lever axle H, it is therefore necessary to mount the door lock 1 at an inherently excessive vertical distance from the oven door 2 in order to preclude such malfunctioning. However, this in turn has the disadvantage that the hook 7 of the locking element 6 does not engage completely in the locking contour 8.

In order to prevent the above-described malfunctioning and disadvantages, the lever axle H can, as can be seen in FIG. 4, be moved in a movement direction V within the slotted guides 25. Due to the lever mechanism which is provided, the lever axle H moves only slightly in relation to the lock housing 3 within the slotted guides 25, even in the event of major changes in the positioning of the oven door 2. The functioning of the actuating shaft 9 is not dependent on where the lever axle H is disposed within the slotted guides 25. The movement direction V forms an angle of somewhat less than 90°, for example an angle of from 65° to 85°, with the axis A. If the oven door 2 is pulled with a force F, having a direction which corresponds to the position of the axis A, when the oven door is in the locked state, the inclined position of the slotted guides 25 prevents the lever axle H of the locking element 6 within the slotted guides 25 from moving in the direction of the open ends of the slotted guides.

Nevertheless, destruction of the door lock 1 should be avoided if the oven door 2 is pulled with an excessive force F, that is to say an attempt is made to forcibly open the oven door. To this end, the retaining plate 23 is mounted in the lock housing 3 in such a way that it can move in the axial direction, that is to say in the direction of the axis A. An angled leaf spring 27, which is firstly tensioned against a side wall 28 of the lower housing part 4 and secondly bears against a front strip 29 of the retaining plate 23, pushes the retaining plate in the axial direction A of the actuating shaft 9 away from a front wall 30 of the lower housing part 4, that is to say in the direction of the geared motor 10. In the case of conventional operation of the door lock 1, that is to say if the emergency-unlocking function is not used, the retaining plate 23 remains pressed against a stop in the locking housing 3 in a fixed position.

Emergency unlocking comes into effect only when the oven door 2 is pulled with forces which greatly exceed the minimum locking forces.

Figure 8:
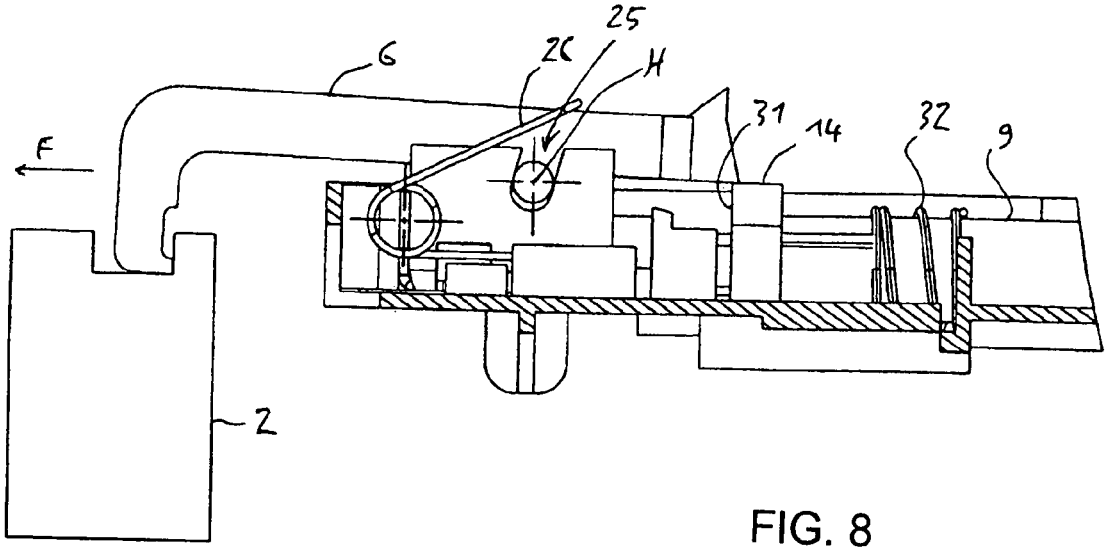
FIGS. 8 and 9 are views similar to FIGS. 3 and 4, of the door lock according to FIGS. 1 to 5, during an emergency-unlocking process.
Figure 9:
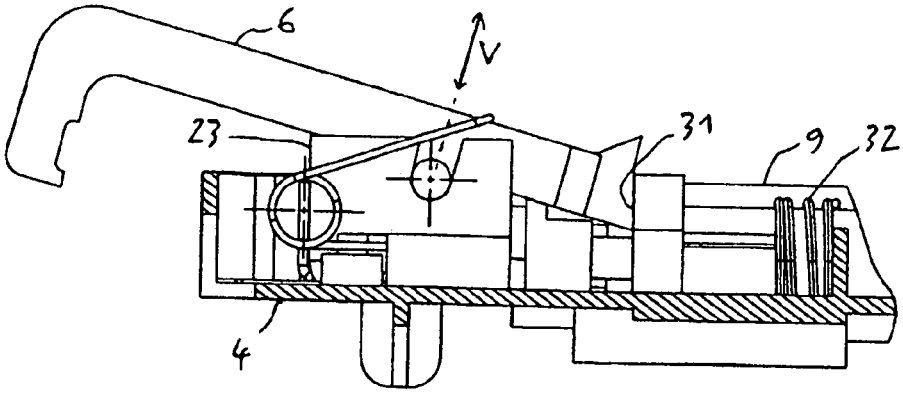
Figure 10:
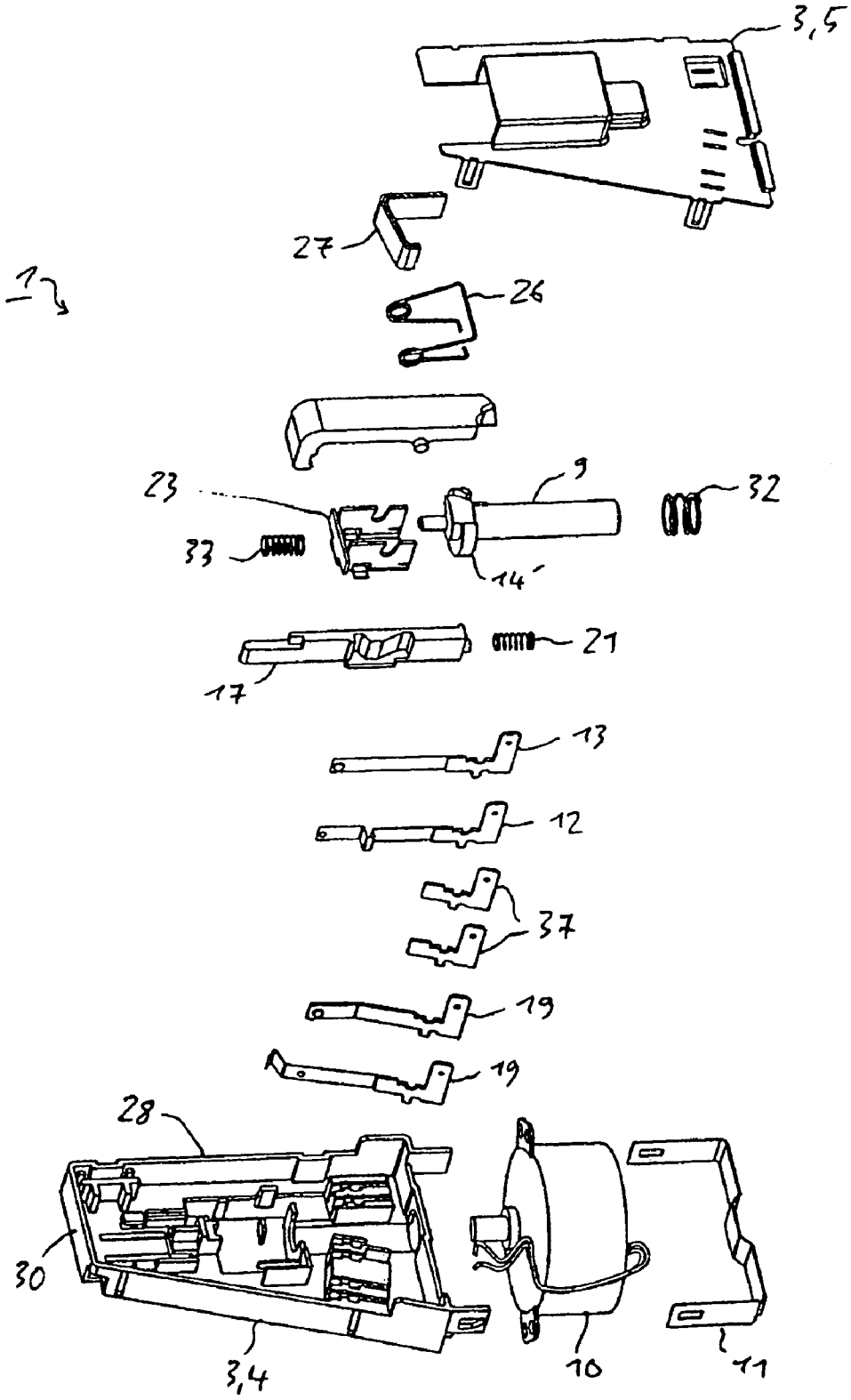
FIG. 10 is an exploded, perspective view similar to FIG. 1, of a second exemplary embodiment of a door lock.

The functioning of emergency unlocking is explained below with reference to FIGS. 8 and 9. The greater the force F with which the oven door 2 is pulled, the more the retaining plate 23 is moved in the direction of the front wall 30 of the lock housing 3 against the force of the leaf spring 27. Finally, as is illustrated in FIG. 9, the operating contour 22 of the lever 6 no longer engages with the eccentric worm 14 or the cam 15 of the actuating shaft 9, with the result that the lever 6 is opened by the force F, in a manner supported by the action of the spring 26. As soon as the lever 6 has opened during the course of emergency unlocking, the operating contour 22 of the lever 6 acts on an end face 31 of the actuating shaft 9.

Like the retaining plate 23, the actuating shaft 9 is mounted in the lock housing 3 in such a way that it can be moved in the longitudinal direction, that is to say it can be moved in the direction of the axis A. A compression spring 32 loads the actuating shaft 9 and counteracts the leaf spring 27, but is constructed to be substantially weaker than the leaf spring. During emergency unlocking of the locking element 6, as soon as the lever 6 flips into the open position (FIG. 9), the leaf spring 27 is therefore at least partially relieved of stress and the compression spring 32 is compressed. Movement of the actuating shaft 9 in the direction of the geared motor 10 also causes the lug 16 to be moved to such an extent that the locking contact system 12, 13 opens. The control system of the door lock 1 therefore receives a signal which indicates that locking of the lever 6 is canceled, even though the angular position of the actuating shaft 9 still corresponds to the locking position. After forcible opening of the oven door 2, the positioning of the mobile parts 6, 9 as is illustrated in FIG. 8, can be reset by rotation of the actuating shaft 9, in a manner driven by the geared motor 10, with the compression spring 32 expanding again and therefore moving the actuating shaft 9 toward the locking element 6 in the axial direction as soon as the locking contour 8 of the locking element no longer engages with the end face 31 of the actuating shaft 9. The overall result is therefore emergency unlocking of the door lock 1 without damaging any components and therefore effective overload protection.

Figure 11:
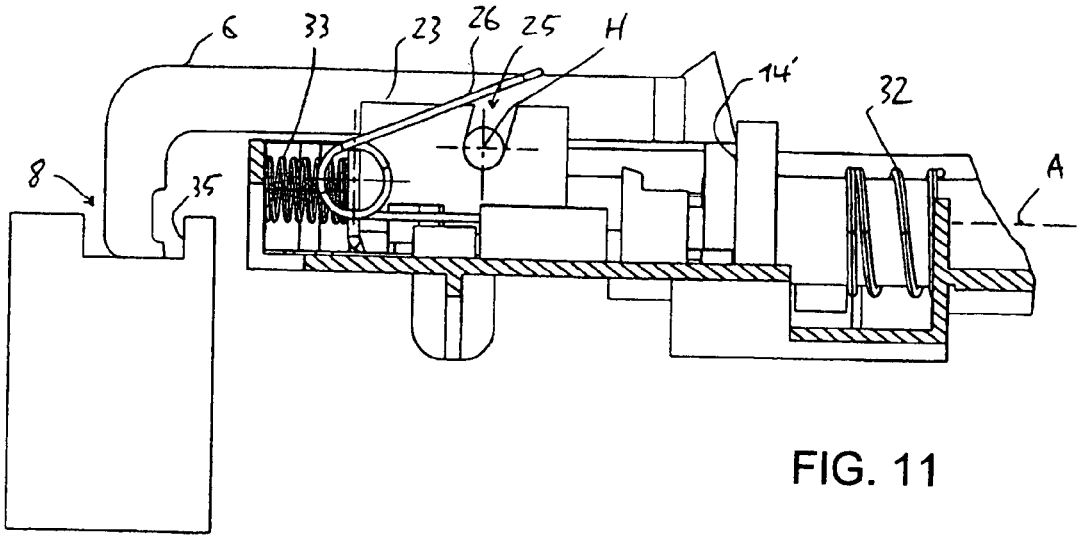
FIG. 11 is a fragmentary, side-sectional view of the door lock according to FIG. 10 and an oven door.
Figure 12:
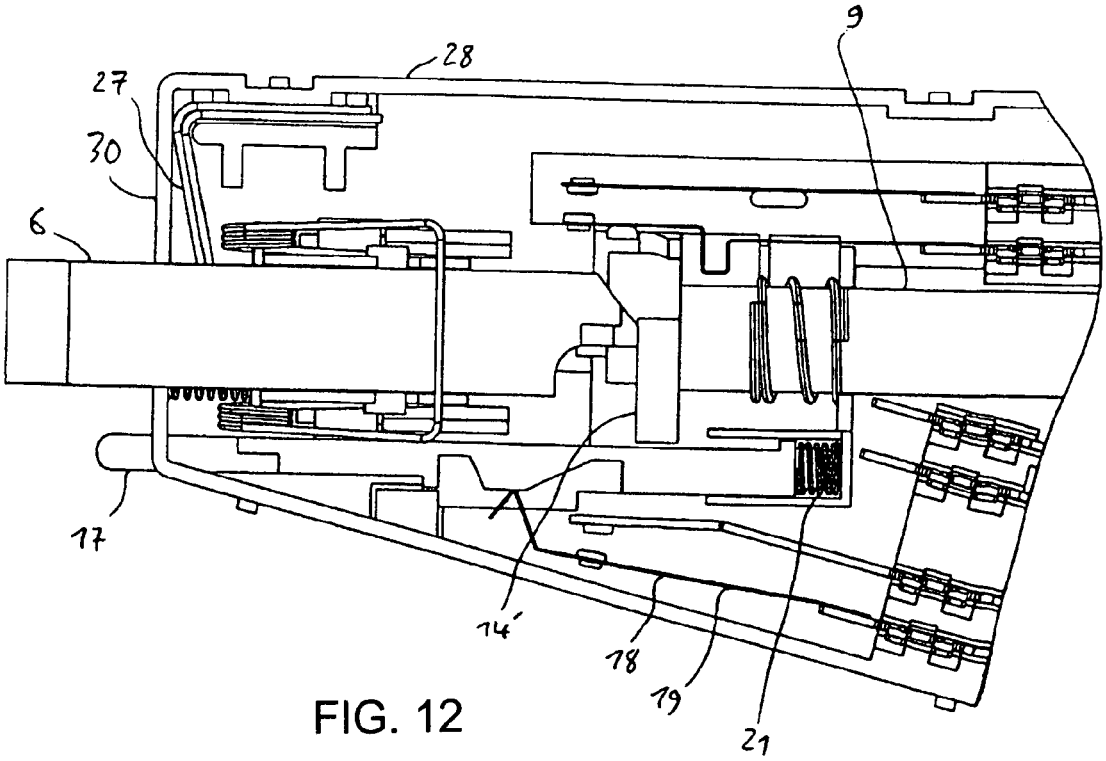
FIG. 12 is a plan view of the configuration according to FIG. 11.

A further exemplary embodiment of a door lock 1 for a baking oven, in particular an oven which is suitable for pyrolytic self-cleaning, is illustrated in FIGS. 10 to 14. In this case, the retaining plate 23 is additionally loaded by a force from a compression spring 33 which, like the leaf spring 27, exerts a force in the direction of the actuating shaft 9, but is constructed to be weak. As long as the lever 6 is open, the compression spring 33 is largely compressed, that is to say the retaining plate 23 is moved close to the front wall 30 of the lock housing 3. In this position of the retaining plate 23, the hook 7 can engage approximately centrally in the locking contour 8 of the oven door 2, as is illustrated in FIG. 11. As long as the lever 6 is tilted by the actuating shaft 9, the axial position of the retaining plate 23 does not change or changes only to an insignificant extent.

Figure 6:
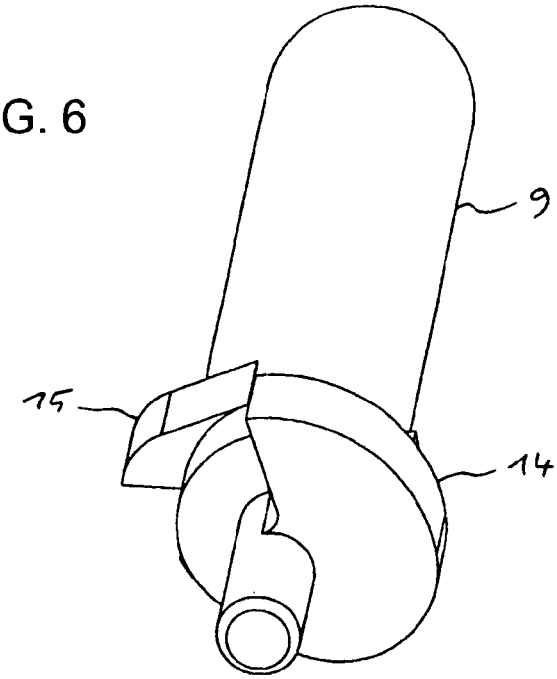
FIGS. 6 and 7 are enlarged, perspective views each respectively showing an eccentric shaft of a door lock according to FIGS. 1 to 5 and according to FIGS. 10 to 14.
Figure 7:
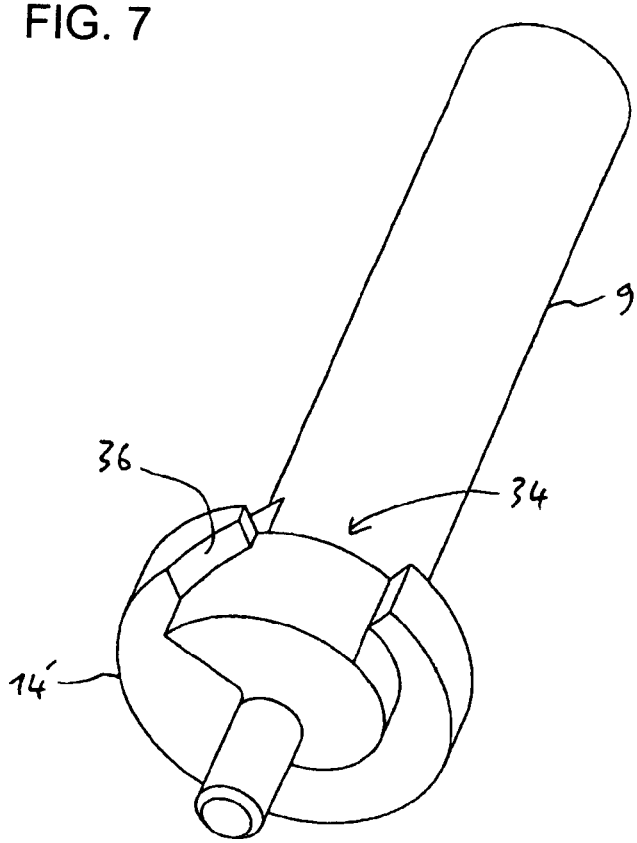
Figure 13:
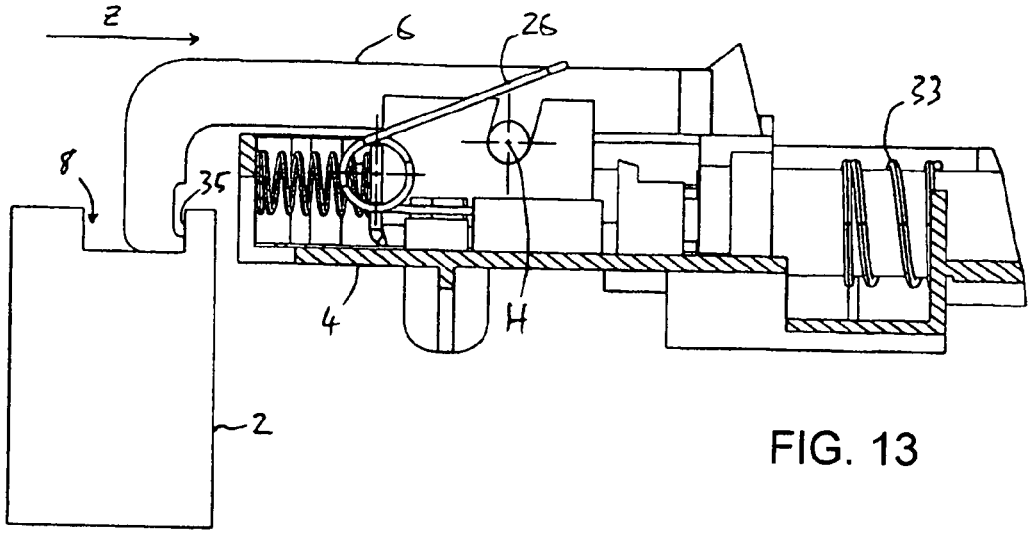
FIG. 13 is a view similar to FIG. 11, of the oven door and the door lock with a closing function activated.
Figure 14:
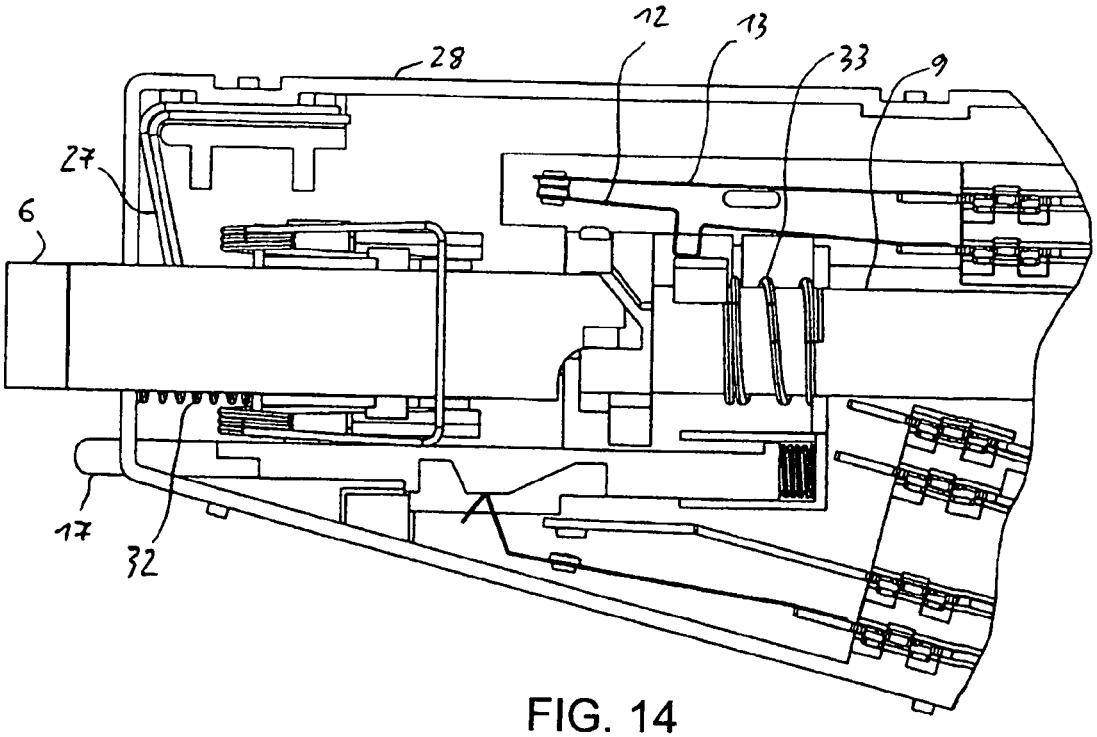
FIG. 14 is a plan view of the configuration according to FIG. 13.

As is illustrated in FIG. 7, an eccentric element 14' of the actuating shaft 9 of the door lock 1 according to FIGS. 10 to 14, which is also referred to as an eccentric worm, is modified in comparison to the actuating shaft 9, which is illustrated in FIG. 6, of the exemplary embodiment according to FIGS. 1 to 5 and has, in particular, the function of controlling not only the tilting movement of the lever 6 but also the movement of the lever in the direction of the axis A. As soon as the lever 6 has reached its maximum deflection in the direction of the locking position, the operating contour 22 of the lever 6 enters an opening section 34 on the eccentric worm 14' (FIG. 7). In this region, the lever 6 remains in the locking position and at the same time moves axially backward, that is to say in the direction of the geared motor 10. During this process, the compression spring 33 expands, as is illustrated in FIG. 13, with the result that the hook 7 comes to rest against a side face 35 of the locking contour 8 and closes the oven door 2 with a tensile force Z. The compression spring 33 exerts a smaller force than the compression spring 32 which always loads the actuating shaft 9. When the lever 6 is unlocked, the retaining plate 23 is initially moved axially in the reverse direction. To this end, the eccentric worm 14' has an inclined face 36 with the aid of which the compression spring 33 is compressed until the position of the lever 6 which is illustrated in FIG. 11 is approximately reached, before which the lever is opened.

The invention claimed is:

1. A door lock for an oven, the door lock comprising:

a lock housing;

a geared motor;

an actuating shaft to be driven by said geared motor and having an axis;

a retaining plate having a slotted guide;

a locking element constructed as a lever to be operated by said actuating shaft, said lever being mounted on said slotted guide of retaining plate and having a lever axle for reversibly changing location relative to said lock housing;

a spring exerting a force being overcome in an emergency-unlocking function permitting adjustment of said retaining plate to allow opening of said lever having been previously brought into a locking position by said actuating shaft, without further operation of said actuating shaft;

another spring loading said lever and exerting a force both on said lever axle in direction of an end position within said slotted guide and on said lever in direction of an open position of said lever; and said actuating shaft to be adjusted along said axis by said lever having been unlocked in an emergency.

2. The door lock according to claim 1, wherein said slotted guide is inclined relative to said axis of said actuating shaft.

3. The door lock according to claim 1, wherein said lever axle is transverse to said axis of said actuating shaft.

4. The door lock according to claim 3, wherein said lever extends substantially parallel to said axis of said actuating shaft.

5. The door lock according to claim 1, which further comprises an electrical locking contact system to be operated by said actuating shaft.

6. The door lock according to claim 1, which further comprises a door contact system being mechanically independent of a position of said actuating shaft and of said lever.

7. The door lock according to claim 6, wherein said door contact system has a slide disposed parallel to said actuating shaft in said lock housing.

8. The door lock according to claim 1, wherein said retaining plate is adjustable along said axis of said actuating shaft in said lock housing.

9. A door lock for an oven, the door lock comprising:

a lock housing;

a geared motor;

an actuating shaft to be driven by said geared motor and having an axis;

a retaining plate;

a locking element constructed as a lever to be operated by said actuating shaft, said lever being mounted on said retaining plate and having a lever axle for reversibly changing location relative to said lock housing;

a spring exerting a force being overcome in an emergency-unlocking function permitting adjustment of said retaining plate to allow opening of said lever having been previously brought into a locking position by said actuating shaft, without further operation of said actuating shaft; and said actuating shaft to be adjusted along said axis by said lever having been unlocked in an emergency, said actuating shaft having a contact element to be operated by an emergency unlocking of said lever and for triggering an electrical actuating operation.

10. A door lock for an oven, the door lock comprising:

a lock housing;

a geared motor;

an actuating shaft to be driven by said geared motor and having an axis;

a retaining plate;

a locking element constructed as a lever to be operated by said actuating shaft, said lever being mounted on said retaining plate and having a lever axle for reversibly changing location relative to said lock housing;

a spring exerting a force being overcome in an emergency-unlocking function permitting adjustment of said retaining plate to allow opening of said lever having been previously brought into a locking position by said actuating shaft, without further operation of said actuating shaft; and said actuating shaft to be adjusted along said axis by said lever having been unlocked in an emergency, said actuating shaft having an eccentric element interacting with said lever for displacing said retaining plate in direction of said actuating shaft by spring force in a locked state of said lever.

11. The door lock according to claim 10, wherein said eccentric element of said actuating shaft causes said retaining plate to be initially adjusted in axial direction of said actuating shaft and then said lever to be pivoted upward, when said lever is unlocked.

* * * * *